United States Patent [19]

Lesse

[11] Patent Number: 4,838,468

[45] Date of Patent: Jun. 13, 1989

[54] REEL FOR REGISTRY OF A MATERIAL WEB PROVIDED WITH CREASE LINES

[75] Inventor: Hakan Lesse, Södra Sandby, Sweden

[73] Assignee: AB Tetra Pak, Lund, Sweden

[21] Appl. No.: 593,403

[22] Filed: Mar. 26, 1984

[30] Foreign Application Priority Data

Mar. 31, 1983 [SE] Sweden ..... 8301823

[51] Int. Cl.[4] ..... B65H 20/00

[52] U.S. Cl. ..... 226/76; 226/87

[58] Field of Search ..... 226/52, 53, 76, 77, 226/86, 87, 168, 174; 242/76; 83/423

[56] References Cited

U.S. PATENT DOCUMENTS

| | | | |
|---|---|---|---|
| 331,803 | 12/1885 | Lumsden | 83/423 X |
| 993,732 | 5/1911 | Storck | 226/52 |
| 1,163,557 | 12/1915 | Reising | 226/76 X |
| 2,119,336 | 5/1938 | Holland-Letz | 83/423 X |
| 2,620,205 | 12/1952 | Vogt | 226/76 X |
| 3,143,955 | 8/1964 | Rockwell | 226/76 X |
| 3,628,408 | 12/1971 | Rod | 83/423 X |
| 4,351,461 | 9/1982 | Carlsson | 226/52 X |
| 4,401,250 | 8/1983 | Carlsson | 226/35 X |

*Primary Examiner*—Harvey C. Hornsby
*Assistant Examiner*—Scott J. Haugland
*Attorney, Agent, or Firm*—Burns, Doane, Swecker & Mathis

[57] ABSTRACT

In the processing of a material web provided with crease lines a reel is used frequently for registry. The reel comprises one or more axial rules, the distance between these being adapted to the distance between transverse crease lines of the material web. To ensure a correct engagement with the crease lines, the rules are relatively sharp which may cause damage to the material web. Supporting elements are provided at the end of the rules so that any material extending beyond the ends is not folded or broken. The reel moreover comprises adjustment facilities for adapting it to varying distances between the transverse crease lines of the material web.

9 Claims, 1 Drawing Sheet

REEL FOR REGISTRY OF A MATERIAL WEB PROVIDED WITH CREASE LINES

BACKGROUND OF THE INVENTION

The present invention relates to apparatus for supporting a moving material web, and more particularly to a rotating reel for engagement with an advancing material web.

In the handing of a packing material web which is provided with a regular pattern of transverse crease lines, the crease line pattern is frequently used for checking and adjusting the registry of the web during the feed so that any processing operations can take place in register with the crease line pattern. This registry may be achieved with the help of different types of registry devices, such as by means of a rotating reel. The reel usually comprises several rules, which are parallel with the axis of rotation of the reel, each being provided with an edge for engagement with transverse crease lines of the web. The reel may drive the web or be driven by the same and it may be made use of for the control of other operations, including printing or driving of the web.

To ensure that the reel maintains its engagement in register with the crease lines, the edges of the rules are ground to be relatively sharp. This functions well on packing material webs of the type where the transverse crease lines co-operating with the reel extend over the whole width of the material. In the case of shorter crease lines which extend only over a limited part of the web width, the edges of the rules must be made shorter so that they do not run out, over, and fold, the material web also in the areas where these crease lines are lacking. These non-creased areas of the material web are usually located along the longitudinal edges of the material web where a sealing process frequently has to be carried out as the material web is being converted to packing containers. This makes it particularly important that these edge areas should be non-folded and plane so as to ensure that the sealing produces a completely liquid-tight join. In case of shorter creases, that is to say creases which extend over a part of the width of the material web, it is thus necessary to provide the reel with shorter rules. It has been found that whilst folding damage in the non-creased areas is prevented by this measure, damage is quite likely to occur on the other hand at the points where the rules or edges terminate. Such damage frequently arises in particular where the web is stressed, that is to say where it is pressed relatively strongly against the edges of the rules which, however, is often necessary so as to ensure registry and to prevent the edges of the reel from ending up outside the crease lines. The problem is particularly great where material webs are processed whereon the mutual distance between the transverse crease lines does not exactly correspond to the specified distance which, of course, has also been chosen as the distance between the edges of the rules on the reel as measured (along the circumference of the reel). This happens relatively often, since the tolerances relating to the distance between the crease lines have to be kept relatively large for reasons connected with the methods of manufacture.

SUMMARY OF THE INVENTION

It is an object of the present invention to provide a rotating reel which is not subject to the disadvantages described above.

It is a further object of the present invention to provide a rotating reel which is designed so that on co-operation with a material web provided with crease lines where the crease lines extend only over a part of the width of the material web they do not damage the material and which, moreover, can be adjusted in a simple manner to fit a crease line pattern which varies within the permitted tolerance limits for the particular material web.

It is a further object of the present invention to provide a rotating reel which is of simple construction and is reliable in operation.

These and other objects have been achieved in accordance with the invention in that a rotating reel for engagement in register with a material web provided with crease lines, this reel comprising an axial rule of a length which substantially corresponds to the length of a crease line intended for engagement with the rule, has been given the characteristic that elements are arranged at the ends of the rule to support the edges of the material web during the engagement between the rule and a crease line, these elements comprising a supporting surface which is situated a little distance behind an imaginary prolongation of the edge of the rule.

The arrangement of elements with supporting surfaces for the material at the edge ends eliminates the danger described earlier of the edges possibly damaging the material when the edges terminate inside the outer edges of the material web, that is to say when the material web is question has transverse crease lines which do not extend over the whole width of the material web. At the same time registry is assured, since the supporting elements are designed so that the different parts of the material web, irrespectively of whether they run over the edges or over the supporting elements, have to cover the same distance. Certain deviations between the lengths of register of different material web, that is to say the distance between the transverse crease lines, can be accommodated by adjusting the circumferential length of the reel in accordance with the invention in a simple manner.

DESCRIPTION OF THE DRAWINGS

A preferred embodiment of the rotating reel in accordance with the invention is shown in the accompanying drawing in which.

DESCRIPTION OF THE PREFERRED EMBODIMENT

Figure 1:
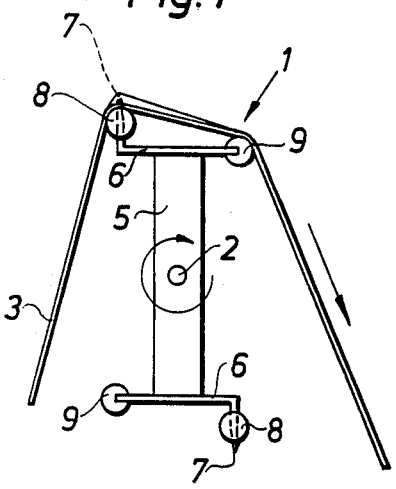
FIG. 1 is a side elevational view of a rotating reel in accordance with the invention and a material web passing over the reel.

A rotating reel 1 in accordance with the invention is shown in FIG. 1. The reel is adapted so as to rotate around a central axis 2 and is supported in a frame of the packing machine not shown in the drawing. The reel can be driven by an electric motor (not shown) or from some other driving source arranged in the packing machine, but it can also be freely rotatable and adapted so as to be driven through engagement with a passing material web 3.

Figure 4:
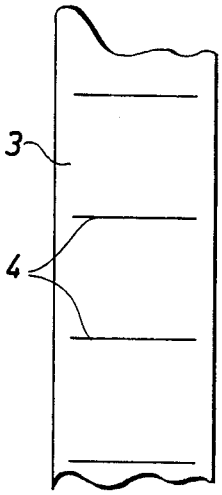
FIG. 4 is a plan view of a type of packing material web with which the reel in accordance with the invention is intended to co-operate.
Figure 5:
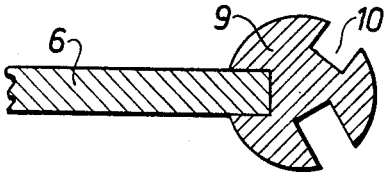
FIG. 5 is a cross-section view through a part of the reel shown in Figure.

The material web consists of a packing laminate which has a central carrier layer of paper, for example which on at least one of its sides is covered by a liquid-tight layer of thermoplastic material, e.g. polyethylene. In a previous operation the material web 3 has been provided, moreover, with transverse crease lines 4 (FIG. 4) which extend over the greater part of the width of the material web but terminate at some distance from the longitudinal edges of the material web. During the following conversion of the packing material web to individual packing containers, which is not described here, but which is of a conventional type, the non-creased edge areas of the material web are made use of for sealing, and it is essential to this end that these edge areas should not have any crease lines, folds or other irregularities which might jeopardize the liquid-tightness of the seal.

The rotating reel 1 comprises a carrier element 5 in the central portion of which is located the central axis 2. At the two opposite ends of the carrier element 5, rules 6 extending parallel with the central axis are provided. The rules 6 have an L-shaped cross-section and face in opposite directions, so that the two end edges of the Ls can make contact with the passing material web 3. The distance between the two rules 6 is adjustable with the help of the carrier element 5 so as to allow adaptation to material webs with different lengths of register, that is to say different distances between the transverse crease lines 4 of the material web.

Figure 2:
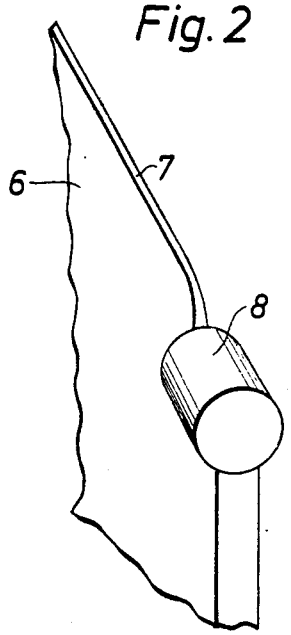
FIG. 2 is a perspective view of a detail of the reel in accordance with FIG.
Figure 3:
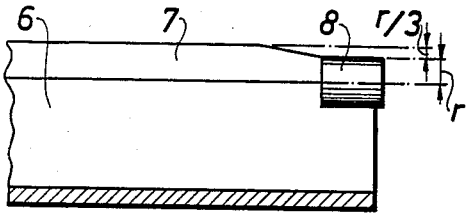
FIG. 3 is a cross-sectional view of a part of the reel shown in FIG. 1

Each rule 6 has on one of its legs (the shorter leg of the Ls) an edge 7 extending parallel with the central axis 2 of the reel. The edge 7 is intended to engage with the crease line 4 of the material web. At the ends of the edge supporting elements 8 (FIG. 2, FIG. 3), are present which comprise a semicylindrical supporting surface situated at a little distance behind an imaginary prolongation of the edge 7 of the rule 6. In the embodiment shown the supporting elements 8 are constituted of cylindrical rolls placed at the ends of the edge 7, these having been rounded off slightly at the same time so as to provide a smooth transition between the effective central part of the edge and the surfaces of the supporting elements (FIG. 3). The supporting elements 8 are of such a shape and are so placed that a web portion (edge area) passing over the supporting surface covers substantially the same length of path as a web portion which passes over the edge of the rule, as illustrated in FIG. 1. Owing to this design any stretching in the material web is avoided at the same time as the registry is improved, and it has been found that a particularly advantageous design is achieved if the supporting surface of the supporting element 8 is in the form of a semicylinder with a radius r and is offset at the distance r/3 from the imaginary projection of the edge 7. Owing to this design substantially the same length of path for different parts of the passing material web is obtained, because the greater distance of the edge 7 from the centre axis 2 of the reel is compensated by the greater width (diameter) of the supporting element 8.

At the opposite leg of the rules 6 (longer leg of the Ls) adjusting devices 9 are present for varying the effective circumferential length of the reel to correspond to the crease line distance on the particular material web. The adjusting devices extend parallel to the central axis 2 of the reel and have a substantially cylindrical cross-sectional shape. The adjusting devices 9 can be turned around an eccentric centre axis so as to increase or diminish the distance between the adjusting device and the centre axis 2 of the reel. In accordance with the preferred embodiment the adjusting device 9 comprises a number of longitudinal grooves 10 of varying depth each of which fits the end edge of the rule so that the adjusting device can be placed in the desired position. By this means the circumference of the reel is adjusted to correspond to the register length of the particular material web so that two successive crease lines 4 will find opposite edges 7 of the reel. The adjusting device 9 is appropriately secured on the rule by means of bolts or flexible elements, e.g. rubber rings, thus making possible a simple adjustment without tools.

When the rotating reel in accordance with the invention is used on a packing machine for checking the register position of a material web, the material web 3 is guided to pass over the rotating reel with a certain angle of contact by guide rollers, not shown in the figure, which control the path of the material web 3 to and from the reel. The distance between the two opposite edges 7 as measured over the adjusting devices 9 has been chosen so that it corresponds to the nominal distance between the transverse crease lines 4 of the material web 3. Through checking by measurement the distance between the transverse crease lines 4 on the material portion which is to be processed it can be determined whether the actual distance corresponds to the nominal distance. If this is not the case, the circumferential length of the reel is adjusted in that the adjusting device 9 is turned until the appropriate recess 10 is fitted to the rule. Through this fine adjustment a simple adaptation of the reel to the length of register of the particular portion of the material is possible.

After the material web 3 with the help of the guide rollers mentioned earlier has been guided along the correct path around the reel the feed of the material web is started by setting the packing machine in motion. Consequently the material web is drawn forth by the packing machine by means of drive rollers (not shown), and the reel rotates continuously by virtue of the engagement between edges 7 and the crease lines 4. To ensure optimum engagement, the material web 3 is guided around the reel with a certain pretension which is regulated by an adjusted braking of the portion of the material web moving to the reel. As a result the material web 3 will lie against the reel, and more particularly its rule 6, with a certain force. The edge 7 will then with certainty retain its position in the particular crease line 4 at the same time as the outer edges of the material web will be supported by the supporting elements 8 so that no stretching or folding whatever of the outer edges will take place. Through the load-relieving effect of the supporting elements 8 damage on the material web at the end parts of the crease lines 4, at the ends of the edge 7 is also prevented. As a result, the thermoplastic layer of the material web is maintained intact, which ensures that the packing containers which are subsequently manufactured from the material web will have good tightness.

On rotation of the reel 1 around the centre axis 2 the edges 7 will engage alternately with successive crease lines 4 in the material web which runs from edge to edge via intermediate adjusting devices 10. Owing to this engagement the reel will rotate in a certain ratio to the material web. This ratio can be read in a known manner e.g. by means of elements coupled to the axle of the reel and used for the control of the feed of the material web, for the control of the dating mechanism or other processing operations.

The rotating reel in accordance with the invention has been found in practical trials to function faultlessly, and makes it possible for the first time by simple means to provide a well-functioning reel which is free of any tendency to cause damage to the material web.

A preferred embodiment of the reel in accordance with the invention has been given. Variations and changes can be made in the apparatus disclosed without departing from the invention, as claimed. The characteristics of the invention are evident from the subsidiary claims.

I claim:

1. A rotating reel for supporting an advancing web of flexible material that has crease lines extending transversely to the direction of advance of said material, said reel comprising:

a central axis;

means for rotating said reel about a central axis;

a plurality of rules mounted on said reel, said rules being spaced radially from said central axis and each rule having an edge with a central major portion extending substantially parallel to said axis and comparatively smaller end portions whose distance from said central axis is less than that of said central major portion;

said rules having a support element mounted on said smaller end portions of the edge, said support elements having a support surface spaced from said central axis a distance less than said central major portion, whereby the central portion of said advancing web is tensioned over said central major portion as the reel rotates, while the lateral edges of said web are carried over said support surfaces.

2. A reel in accordance with claim 1, wherein the said support element comprises a semicylindrical supporting surface with a radius r which is facing in the same direction as the edge, said surface being situated at the distance r/3 closer to said central axis than said rule edge.

3. A reel in accordance with claim 1 wherein said reel has two rules and adjusting devices located between the rules seen in circumferential direction of the reel for adapting the effective circumferential length of the reel to the crease line distance on the particular material web.

4. A reel in accordance with claim 3, wherein the adjusting devices are of substantially cylindrical shape and can be turned around an eccentric central axis.

5. The rotating reel according to claim 1 wherein said support element has a wider supporting surface than said edge to compensate for the longer circumferential path over said rule edge.

6. The rotating reel according to claim 1 wherein at least one of said rules has an adjusting device, said adjusting device being spaced circumferentially of said rule edge and extending substantially parallel to said edge, said adjusting device having a surface for supporting said advancing web and means for adjusting the distance between said device surface and said central axis.

7. The rotating reel according to claim 6 wherein said rules have an L-shape in cross-section, said edge being arranged on one leg of said L-shaped rule and said adjusting device being mounted on the other leg of said L-shaped rule.

8. The rotating reel according to claim 7 wherein said means for adjusting includes a bar having a plurality of axial grooves spaced circumferentially around said bar, said grooves having different depths from each other, whereby the supporting surface of said adjusting device can be varied by turning the bar and inserting said other leg into a selected one of said grooves.

9. The rotating reel according to claim 1 wherein the edges of said rules are spaced axially from said support elements and include a transition portion extending between said edges and said support elements.

* * * * *